United States Patent [19]

Kalback

[11] Patent Number: 4,904,371

[45] Date of Patent: Feb. 27, 1990

[54] PROCESS FOR THE PRODUCTION OF MESOPHASE PITCH

[75] Inventor: Walter M. Kalback, Ponca City, Okla.

[73] Assignee: Conoco Inc., Ponca City, Okla.

[21] Appl. No.: 258,301

[22] Filed: Oct. 13, 1988

[51] Int. Cl.[4] ..... C10G 27/00; C10C 3/04; C10C 3/02

[52] U.S. Cl. ..... 208/39; 208/4; 208/6; 208/44; 423/447.4; 423/447.6; 423/447.7; 423/447.8

[58] Field of Search ..... 208/4, 6, 39, 44; 423/447.6, 447.7, 447.8

[56] References Cited

U.S. PATENT DOCUMENTS

| | | | |
|---|---|---|---|
| 3,116,229 | 12/1963 | Eisenhut | 208/44 |
| 3,350,295 | 10/1967 | Hamner et al. | 208/4 |
| 3,595,946 | 7/1971 | Joo et al. | 264/29 |
| 3,856,657 | 12/1974 | Seinfeld et al. | 208/4 |
| 3,904,389 | 9/1975 | Ruckel et al. | 208/4 |
| 3,974,264 | 8/1976 | McHenry | 423/447.4 |
| 3,976,729 | 8/1976 | Lewis et al. | 264/29.7 |
| 4,017,327 | 4/1977 | Lewis et al. | 423/447.4 |
| 4,026,788 | 5/1977 | McHenry | 208/39 |
| 4,042,486 | 8/1977 | Asano et al. | 208/44 |
| 4,066,737 | 1/1978 | Romovacek | 423/447.6 |
| 4,096,056 | 6/1978 | Haywood et al. | 208/4 |
| 4,176,043 | 11/1979 | van Eijk | 208/44 |
| 4,209,500 | 6/1980 | Chwastiak | 423/447.6 |
| 4,303,631 | 12/1981 | Lewis et al. | 423/447.1 |
| 4,474,617 | 10/1984 | Uemura et al. | 208/6 |
| 4,664,774 | 5/1987 | Chu et al. | 208/6 |
| 4,671,864 | 6/1987 | Sawran et al. | 208/22 |

FOREIGN PATENT DOCUMENTS

| | | |
|---|---|---|
| 221707 | 11/1972 | Fed. Rep. of Germany . |
| 65090 | 2/1986 | Japan . |

*Primary Examiner*—Helane Myers

[57] ABSTRACT

An improved process for producing an anisotropic pitch product suitable for carbon fiber manufacture. A carbonaceous feedstock substantially free of mesophase pitch is heated for a period of time at an elevated temperature while passing an oxidatively reactive sparging gas such as a mixture of oxygen and nitrogen through the feedstock. The oxidatively treated feedstock is then subjected to a heat soak, for a longer period of time in the absence of a sparging gas. Thereafter the heat soaked feedstock is heated at an elevated temperature in the presence of a non-oxidative sparging gas for a time period equal to or less than the heat soak to produce an anisotropic pitch having from 50 to 100% by volume mesophase which is suitable for producing good quality carbon fibers.

15 Claims, No Drawings

PROCESS FOR THE PRODUCTION OF MESOPHASE PITCH

BACKGROUND OF THE INVENTION

1. Field of the Invention

The present invention pertains to an improved process for producing a carbonaceous pitch product having a mesophase content ranging from about 50 to 100%. which is suitable for carbon fiber manufacture. More particularly, the invention relates to a process for making mesophase containing pitch capable of producing carbon fibers having enhanced properties, by contacting a feedstock for a period of time with an oxidative gas at an elevated temperature, subjecting the oxidatively treated feedstock to a heat soak in the absence of a sparging gas for a longer period of time and thereafter subjecting heat soaked feedstock to sparging with a non-oxidative gas at an elevated temperature for a time period equal to or less than the heat soak.

2. The Prior Art

In recent years extensive patent literature has evolved concerning the conversion of carbonaceous pitch feed material into a mesophase-containing pitch which is suitable for the manufacture of carbon fibers having desirable modulus of elasticity, tensile strength, and elongation characteristics.

U.S. Pat. No. 4,209,500 (issued to Chwastiak) is directed to the production of a high mesophase content pitch that can be employed in the manufacture of carbon fibers. This patent is one of a series of patents pertaining to a process for producing mesophase pitches suitable for carbon fiber production. Each of these patents broadly involves heat treating or heat soaking the carbonaceous feed while agitating and/or passing an inert gas therethrough so as to produce a more suitable pitch product for the manufacture of carbon fibers.

As set forth in the Chwastiak patent, earlier U.S Pat. Nos. 3,976,729 and 4,017,327 issued to Lewis et al. involve agitating the carbonaceous starting material during the heat treatment. The use of an inert sparge gas during heat treatment is found in U.S. Pat. Nos. 3,974,264 and 4,026,788 issued to McHenry. Stirring or agitating the starting material while sparging with an inert gas is also disclosed in the McHenry patents.

U.S. Pat. No. 3,595,946 (Joo et al.) discloses heat treating and distilling coal tar pitch to increase its average molecular weight by polymerization. Various oxidizing. dehydrogenating and polymerization agents may be employed to expedite the process. The treated pitch is spun into filament which is oxidized and then carbonized.

U.S. Pat. No. 4,474,617 (Uemura et al.) describes treating low mesophase content pitch with oxidizing gas at a temperature of 200° to 350° C. to produce an improved carbon fiber.

Japanese Pat. No. 65090 (Yamada et al.) describes making a mesophase pitch for carbon fiber manufacture by heat treating feed in the presence of oxidizing gas at 350° to 500° C.

Koppers Co. Inc. has published Ger. Offen. DE 2,221,707 patent application, which discloses manufacture of isotropic carbon fibers wherein the starting material is first reacted with oxygen and then vacuum distilled, to remove non-oxidized lower-boiling components.

U.S. Pat. No. 4,664,774 shows a method for obtaining a coal tar pitch by oxidizing heavy oils by sparging with air, followed by stripping with an inert gas stream to remove undesirable low-boiling constituents.

U.S. Pat. No. 4,096,056 discloses producing a pitch (from petroleum), having a softening point of 135° C., which would define an isotropic pitch. The highest processing temperature is below the normal sparging temperature. The patent describes an oxygen treatment in a two-step process.

U.S. Pat. No. 4,303,631 shows producing a spinnable mesophase by first heat treating and then sparging with an inert gas.

U.S. Pat. No. 4,066,737 shows reaction of distillate with oxygen to produce a pitch. The process appears to produce a non-graphitizable pitch.

SUMMARY OF THE INVENTION

In accordance with the present invention, it has now been found that a pitch product containing 50 to 100% by volume mesophase, as determined by optical anisotropy, is obtained by contacting a carbonaceous feedstock substantially free of mesophase pitch with an oxidative gas at an elevated temperature for a period of time. The oxidatively treated feedstock is then subjected to a heat soak in the absence of a sparging gas. The heat soak step is carried for a substantially longer time period than the oxidative treatment. The heat soaked feedstock is then subjected to sparging with a non-oxidative gas at an elevated temperature for a time period equal to or less than the heat soak. The resulting pitch product, often substantially 100% mesophase, has a melting point suitable for fiber spinning and results in fibers having excellent properties.

DETAILED DESCRIPTION OF THE INVENTION

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates.

Generally, pitches having a high degree of aromaticity are suitable for carrying out the present invention.

Carbonaceous pitches having an aromatic carbon content of from about 75% to about 90% as determined by nuclear magnetic resonance spectroscopy are particularly useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed about 4% by weight of the pitch. Also, these useful pitches typically will have an average molecular weight of the order of about 200 to 1,000.

Those petroleum pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of about 90% by volume and higher, during heat treatment at elevated temperatures, for example in the range of 350° C. to 450° C. are especially preferred starting materials for the practice of the present invention.

In general, any petroleum or coal-derived heavy hydrocarbon fraction may be used as the carbonaceous feedstock in the process of this invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range of from 650°–950° F. The use of petroleum pitch-type feed is preferred The preferred gas for the oxidation treatment of the carbonaceous feedstock is a mixture of oxygen and nitrogen containing from about 0.5 to about 5% oxygen, and preferably from about 2 to about 5% oxygen. Gases other than oxygen such as ozone, hydrogen peroxide, nitrogen dioxide, formic acid vapor and hydrogen chloride vapor, may also be used as the oxidative component in the process. These oxidative gases are also used in admixture with inert (non-oxidative) components such as nitrogen, argon, xenon, helium, methane, hydrocarbon-based flue gas, steam, and mixtures thereof. In general, there may be employed any gas stream or a mixture of various gas streams with an appropriate oxidative component leaving an oxidative reactivity for the mesophase forming feed equivalent to that provided by using the oxygen concentrations in the ranges disclosed.

The temperature employed in the oxidative step is usually between about 350° C. and about 500° C. and preferably from about 370° C. to about 425° C. The oxidative gas rate is at least 0.1 SCFH per pound of feed, preferably from about 1.0 to 20 SCFH. Sparging with the oxidative gas is generally carried out at atmospheric or slightly elevated pressures, e.g. about 1 to 3 atmospheres, but higher pressures may be used if desired. The oxidative sparging time period will vary depending on the feedstock, gas feed rates, and the like. Time periods from about 2 to about 6 hours are generally used Preferably the oxidative sparging time constitutes from about 15 to about 20 percent of the total time utilized in the overall process of the invention.

Generally the melting temperature of mesophase pitches is increased by the oxidation treatment. It is usually desirable to spin a mesophase pitch with a melting temperature below 360° C. and preferably below 340° C. Thus, the oxidizing conditions, including the treatment time, are controlled so that the mesophase pitch melting temperature is maintained at an acceptable level for spinning.

In the second stage of the process the carbonaceous feedstock is subjected to a heat soak in the absence of a sparging gas. The temperature employed in this step is similar to that used in the oxidation treatment, viz. from about 350° C. to about 500° C. and preferably from about 370° C. to about 425° C. As in the oxidation step the time period of heat soaking will vary, usually from about 6 to about 20 hours and preferably from about 10 to about 18 hours. In any event heat soaking will consume a greater time period than the oxidative treatment and will usually constitute from about 40 to about 55 percent of the total time utilized in the overall process of the invention.

Conversion of the heat soaked carbonaceous feedstock to mesophase pitch is completed by subjecting the oxidized and heat soaked feedstock to elevated temperatures usually at atmospheric pressure with inert gas sparging and with agitation as desired. The operating conditions employed, which are similar to those used in the oxidation step, include temperatures in the range of about 350° C. to about 500° C. and preferably from about 370° C. to about 425° C. The heating step is carried out over a time period equal to or less than that employed in the heat soak step, usually between about 4 and about 10 hours, depending on the temperature employed. Preferably the inert gas sparging phase of the process constitutes from about 20 to about 0 percent to the total time utilized in the overall process.

A variety of inert gases may be used as a sparging material including nitrogen, argon, carbon dioxide, helium, methane, carbon monoxide, and steam. Sparging is carried out at a gas rate of at least 0.1 SCFH per pound of feedstock and preferably from about 1.0 to about 20 SCFH per pound, and usually at the same rate as in the oxidation step.

The three step process of the invention is usually carried out over a time period of from about 24 to about 30 hours and preferably from about 24 to about 28 hours The formation of mesophase pitch is a time-temperature function; therefore as the total process time is varied appropriate changes in the temperature employed in the three steps will be necessary. For ease of operation the three steps are usually carried out at substantially the same temperature, however, it is within the scope of the invention to use different temperatures in two or all three steps with appropriate control of the process time period of each step.

The heat required for the process steps may be provided in any conventional manner, e g. by indirect heat exchange with hot oil, by electrical energy or by other means.

The mesophase pitch produced in the process of this invention may be spun into continuous anisotropic carbon fibers by conventional procedures such as melt spinning, followed by the separate steps of thermosetting and carbonization. As indicated, these are known techniques and consequently they do not constitute critical features of the present invention.

The present invention will be more fully understood by reference to the following illustrative embodiments.

EXAMPLE 1

Heavy residual fractions (850° F.+fraction) of heavy oils from three FCC units were used as feedstocks for the preparation of mesophase pitch precursor. A glass reactor with capacity around 340 ml was used for the tests and was charged with approximately 200 grams of the heavy residual oil. An oxygen-nitrogen mixture was used as the gas for the oxidation treatment, at a rate of 4.0 SCFH/lb of reactor charge. Inert gas sparging was carried out with nitrogen, also at a rate of 4.0 SCFH/lb of reactor charge. The oxidation step, heat soak and inert gas sparging were all effected at 385° C. (725° F.) For comparison purposes, runs were made with oxidation only and with nitrogen sparging only. Runs were made over time intervals of 24 hours and 28 hours. The yields of products obtained from the tests are provided in the Table.

TABLE

| Total Time, hr O2/HS/N2 | | | % O2 | Meso, % | Meso Yld, wt % | Increase Over Base Case, % |
|---|---|---|---|---|---|---|
| | | | Feedstock #1 (24 Hours) | | | |
| 0 | 0 | 24 | 0 | 95 | 19.1 | Base Case |
| 8 | 0 | 16 | 0.5 | 100 | 22.8 | +19 |
| 16 | 0 | 8 | 0.5 | 100 | 23.0 | +20 |
| 4 | 0 | 20 | 1.0 | 100 | 22.5 | +18 |
| 6 | 0 | 18 | 1.0 | 100 | 23.9 | +25 |
| 8 | 0 | 16 | 1.0 | 99 | 24.1 | +26 |
| 24 | 0 | 0 | 1.0 | 100 | 26.6 | +39 |
| 4 | 16 | 4 | 5.0 | 69 | 30.1 | +58 |
| 4 | 12 | 8 | 5.0 | 100 | 36.9 | +93 |
| 4 | 10 | 10 | 5.0 | 100 | 36.7 | +92 |
| | | | Feedstock #1 (28 Hours) | | | |
| 0 | 0 | 28 | 0 | 100 | 19.3 | Base Case |
| 28 | 0 | 0 | 0.5 | 100 | 23.5 | +22 |
| 19 | 0 | 9 | 1.0 | 100 | 26.1 | +35 |
| 6 | 16 | 6 | 2.0 | 94 | 28.2 | +46 |
| | | | Feedstock #2 (24 Hours) | | | |
| 0 | 0 | 24 | 0 | 100 | 15.1 | Base Case |
| 24 | 0 | 0 | 0.5 | 100 | 20.0 | +32 |
| 24 | 0 | 0 | 1.0 | 100 | 22.9 | +51 |
| 4 | 12 | 8 | 5.0 | 100 | 37.5 | +148 |
| 4 | 14 | 6 | 5.0 | 99 | 34.8 | +130 |
| | | | Feedstock #3 (28 Hours) | | | |
| 0 | 0 | 28 | 0 | 100 | 22.8 | Base Case |
| 6 | 0 | 22 | 1.0 | 100 | 25.0 | +10 |
| 4 | 20 | 4 | 5.0 | 78 | 29.6 | +30 |

It is noted from the data that the yields from the three step process of the invention are substantially greater than with nitrogen sparging and are even greater than for a similar time period consisting entirely of sparging with oxygen in nitrogen.

Various changes and modifications can be made in the process of this invention without departing from the spirit and scope thereof. The various embodiments which have been described herein are for the purpose of illustrating the invention, and are not intended to limit it.

I claim:

1. A process for producing a mesophase pitch suitable for carbon fiber manufacture which comprises heating a carbonaceous feedstock substantially free of mesophase pitch in the presence of an oxidatively reactive sparging gas at a temperature above 350° C. for a period of time ranging up to about 6 hours, thereafter subjecting the carbonaceous feed to heat soaking in the absence of a sparging gas for up to 20 additional hours at a temperature above 350° C., and then heating the carbonaceous feed in the presence of a non-oxidative sparging gas for up to 10 hours at a temperature above 350° C. and thereby forming mesophase pitch.

2. The process of claim 1 in which the sum of the treating time periods varies from about 24 to about 30 hours.

3. The process of claim 2 in which the heat soaking time period is greater than the oxidation time period and is equal to or greater than the inert gas sparging time period.

4. The process of claim 1 in which the oxidatively reactive gas is selected from the group consisting of oxygen, ozone, hydrogen peroxide, nitrogen dioxide, formic acid vapor, hydrogen chloride vapor, and mixtures thereof.

5. The process of claim 4 in which the oxidatively reactive gas is used in admixture with an inert gas.

6. The process of claim 5 in which the oxidatively reactive gas is a mixture of oxygen and nitrogen.

7. The process of claim 6 in which the carbonaceous feedstock is a pitch.

8. The process of claim 7 in which the feedstock is a petroleum pitch.

9. A process for producing a mesophase pitch suitable for carbon fiber manufacture which comprises heating a carbonaceous feedstock substantially free of mesophase pitch in the presence of an oxidatively reactive sparging gas at a temperature between about 350° C. and about 500° C. and a sparging gas rate from about 1.0 to about 20 SCFH per pound of feedstock, thereafter subjecting the carbonaceous feed to heat soaking in the absence of a sparging gas at a temperature between about 350° C. and about 500° C. and then heating the carbonaceous feed in the presence of an inert sparging gas at a temperature between about 350° C. and about 500° C. and at a sparging gas rate from about 1.0 to about 20 SCFH per pound of feedstock and thereby forming mesophase pitch, wherein the time periods of oxidative gas sparging, heat soaking and inert gas sparging are between about 15 percent to about 20 percent, between about 40 percent and about 55 percent and between about 20 percent and about 40 percent respectively of the total time employed in the overall process.

10. The process of claim 9 in which the total time employed in the overall process varies from about 24 to about 30 hours.

11. The process of claim 10 in which the oxidatively reactive gas is selected from the group consisting of oxygen, ozone, hydrogen peroxide, nitrogen dioxide, formic acid vapor, hydrogen chloride vapor, and mixtures thereof.

12. The process of claim 11 in which the oxidatively reactive gas is a mixture of oxygen and nitrogen in which the oxygen content is between about 0.5 and about 5 percent.

13. The process of claim 12 in which the inert gas used in the inert gas sparging step is nitrogen.

14. The process of claim 13 in which the carbonaceous feedstock is a carbonaceous pitch.

15. The process of claim 14 in which the oxidation step, heat soaking step and inert gas sparging step are carried out over a total time period of between about 24 and about 30 hours and the three steps are conducted at approximately the same temperature.

* * * * *